United States Patent [19]

Jagger

[11] 4,111,565

[45] Sep. 5, 1978

[54] APPARATUS FOR SENSING WHEN PAPER UTILIZED IN A PRINTER HAS BEEN DEPLETED

[75] Inventor: Brian E. Jagger, Union City, Calif.

[73] Assignee: Xerox Corporation, Stamford, Conn.

[21] Appl. No.: 781,906

[22] Filed: Mar. 28, 1977

[51] Int. Cl.[2] ..... B41J 29/44

[52] U.S. Cl. ..... 400/708; 400/616.2; 226/11; 226/100; 200/61.18

[58] Field of Search ..... 226/11, 48, 100; 197/189; 101/233; 200/61.41, 61.13–61.18

[56] References Cited

U.S. PATENT DOCUMENTS

| | | | |
|---|---|---|---|
| 2,676,513 | 4/1954 | Engstrom | 226/11 |
| 3,103,040 | 9/1963 | Dughette | 226/11 |
| 3,859,649 | 1/1975 | Slack | 226/100 |
| 4,019,619 | 4/1977 | Emenaker | 101/233 |

FOREIGN PATENT DOCUMENTS

| | | | |
|---|---|---|---|
| 1,258,863 | 3/1960 | France | 197/189 |

*Primary Examiner*—William Pieprz

*Attorney, Agent, or Firm*—Irving Keschner; Barry Paul Smith

[57] ABSTRACT

Apparatus adapted for use in printers for indicating when the paper upon which information is to be printed has been depleted. A pivotable sensing member is slightly biased towards a fixed guide member, the two members being adjacent to one another. The sensing member has a horizontal row of protrusions on its inner wall which entend towards the opposing wall of the fixed member. The opposing wall of the fixed member similarly has a horizontal row of protrusions extending towards the sensing member but being aligned between the protrusions on the sensing member. In the situation wherein no paper is introduced between said members, a switch associated with the sensing member provides an indication to control circuiting that no paper is present for printing. When paper is introduced between the protrusions, the slight bias of the sensing member is overcome by particular characteristics of the paper and the sensing member is pivoted away from the fixed member causing the switch associated with the sensing member to change condition and provide an indication to the control circuitry that paper is present between the two members. The protrusions in effect amplify the pivotable motion of the sensing member such that the switch means is responsive to paper of various thicknesses. The sensing member also acts as a paper drag in the case of continuous form, folded paper such that the paper folds conform to the printer platen whereby information can be printed, if required, accurately on the paper fold line.

3 Claims, 5 Drawing Figures

APPARATUS FOR SENSING WHEN PAPER UTILIZED IN A PRINTER HAS BEEN DEPLETED

BACKGROUND OF THE INVENTION

Printers, and in particular, serial printers, have taken many forms over the decades with the most common and widespread one being the typewriter. In recent years, the seemingly exponential increasing use of computer-based high speed information processing systems has placed a strong demand on serial printers in terms of speed, performance and reliability. A serial printer with control apparatus that is capable of meeting the ever more exacting contemporary requirements of speed, performance and reliability, is disclosed in copending application Ser. No. 682,877, filed on May 3, 1976 and assigned to the assignee of the present invention. As disclosed in this application, a record material is positively fed through the serial printer along a platen and past a printing station whereat the desired information is imparted to the record material, or paper. Since printer operation is obviously dependent on the availability of the paper, apparatus which can sense the absence (or presence) of record material in the printer and provide an indication of that condition to the printer (the printer in turn, if desired, causing printer shutdown and an indication to the printer operator that additional paper is required) would be desirable.

Prior art sensors which provided an indication whether printing paper was depleted and additional paper was to be added have been limited in application since the sensors utilized (i.e. photoelectric devices) were dependent, in part, on the paper width, the position of the paper on the platen and the thickness of the paper. These limitations have been overcome in the prior art by readjusting the sensors for each paper run in the printer, an obviously costly and time consuming procedure. Therefore, it would be desirable if apparatus could be provided which, inter alia, can sense the presence or absence of paper in a printer and which is essentially independent of paper width, paper thickness and the position of the paper on the platen.

SUMMARY OF THE PRESENT INVENTION

The present invention provides apparatus adapted for use in printers for indicating when the paper upon which information is to be printed has been depleted. A pivotable sensing member is slightly biased towards a fixed guide member, the two members being adjacent to one another. The sensing member has a horizontal row of protrusions on its inner wall which extend towards the opposing wall of the fixed member. The opposing wall of the fixed member similarly has a horizontal row of protrusions extending towards the sensing member but being aligned between the protrusions on the sensing member. In the situation wherein no paper is introduced between said members, a switch associated with the sensing member provides an indication to control circuitry that no paper is present for printing. When paper is introduced between the protrusions, the slight bias of the sensing member is overcome by particular characteristics of the paper and the sensing member is pivoted away from the fixed member causing the switch associated with the sensing member to change condition to provide to the control circuitry an indication that paper is present between the two members. The protrusions in effect amplify the pivotable motion of the sensing member such that the switch means is responsive to paper of various thicknesses which otherwise may not be detected. The sensing member also acts as a paper drag in the case of continuous form, folded paper, such that the paper folds conform to the printer platen whereby information can be printed, if required, on the paper fold line. The use of the protrusions along the substantial length of both members also allows lateral movement of paper therebetween which is substantially free of interference if the paper supply is misaligned.

It is an object of the present invention to provide apparatus for sensing when paper being supplied to a printer has been depleted.

It is a further object of the present invention to provide apparatus for sensing a variety of paper thicknesses and to determine whether paper of a particular thickness being supplied to a printer has been depleted.

It is still a further object of the present invention to provide apparatus for sensing when paper being supplied to a printer is depleted and which comprises a pivotable sensing member slightly biased towards a fixed guide member, the two members being adjacent to one another. The sensing member has a horizontal row of protrusions on its inner wall which extends towards the opposing wall of the fixed member. The opposing wall of the fixed member similarly has a horizontal row of protrusions extending towards the sensing member but being aligned between the protrusions on the sensing member. In the situation wherein no paper is introduced between said members, a switch associated with the sensing member provides an indication to control circuitry that no paper is present for printing. When paper is introduced between the protrusions, the slight bias of the sensing member is overcome by particular characteristics of the paper and the sensing member is pivoted away from the fixed member causing the switch associated with the sensing member to change condition and provide an indication that paper is present between the two members. The protrusions in effect amplify the pivotable motion of the sensing member such that the switch means is responsive to paper of various thicknesses which otherwise might not be detected. The sensing member also acts as a paper drag in the case of continuous form, folded paper, such that the paper folds conform to the printer platen whereby information can be printed, if required, on the paper fold line. The use of the protrusions along the substantial length of both members also allows lateral movement of paper therebetween, but is substantially free of interference if the paper supply is misaligned.

BRIEF DESCRIPTION OF THE DRAWINGS

For a better understanding of the present invention as well as other objects and further features thereof, reference is made to the following description which is to be read in conjunction with the following figures wherein.

DESCRIPTION OF THE PREFERRED EMBODIMENT

Figure 1:
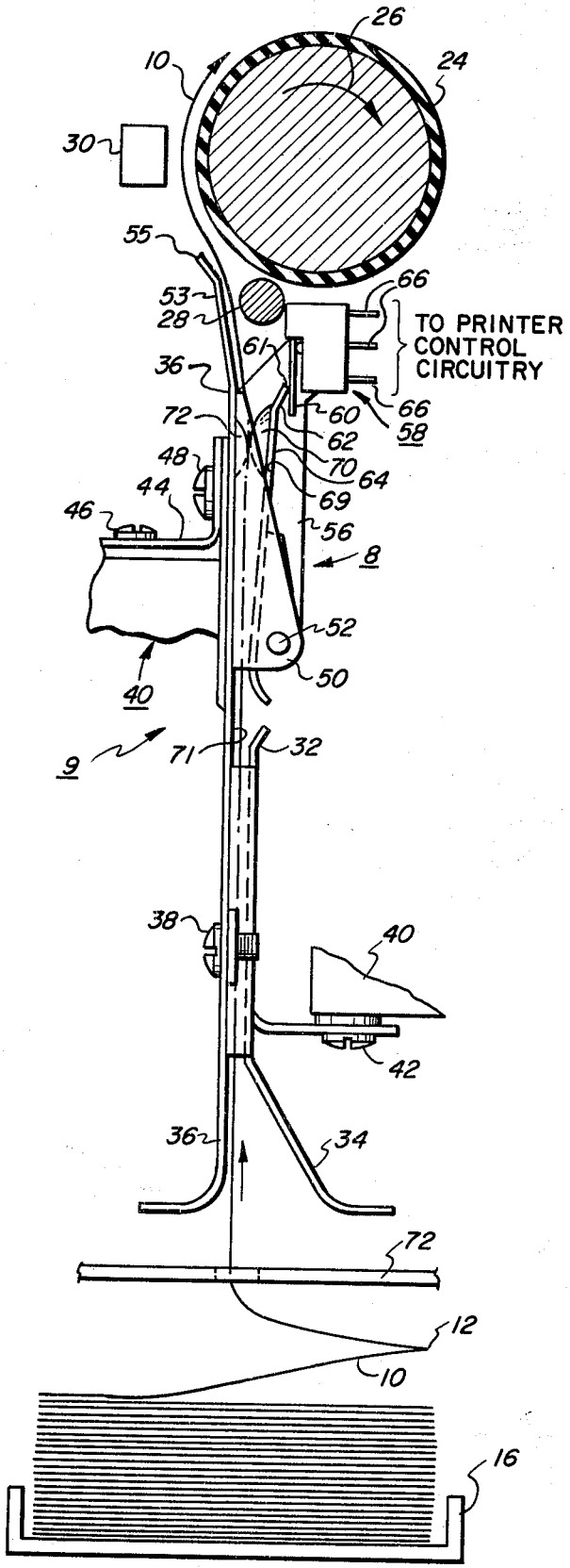
FIG. 1 is a side view showing how the paper sensing apparatus of the present invention is utilized in a printing system.

Referring to FIG. 1, a side elevation view of printing apparatus which is arranged to incorporate the sensing apparatus 8 of the present invention, part of paper chute assembly 9, is shown in a simplified representational form. A printing apparatus which can be adapted to incorporate the sensing apparatus of the present invention is disclosed in the aforementioned copending application Ser. No. 682,877, the teachings of which that are necessary for an understanding of the present invention being incorporated herein by reference.

A record material, or printing paper 10, preferably of a continuous form and having folds 12 therein, is stored in storage member 16 and introduced into a paper chute assembly 9 via an aperture in a bottom member 22 which forms a portion of the printer main frame. With the pivotable portion of the paper sensing apparatus 8 positioned as shown (described in more detail hereinafter), paper 10 is driven by means (not shown) through the paper chute assembly 9 (and past the pivoted portion of the paper sensing apparatus 8) along a printing platen 24 rotating in the direction of arrow 26 via idler roller 28 and past a printing station 30 whereat information is printed on the paper 10. The paper 10 is driven past the printing station 30 as the platen 24 is rotated either manually or automatically.

The paper chute assembly 9 comprises a first fixed member, or rear paper chute, 32 having an angled lower portion 34, an elongated, second fixed member or front paper chute, 36 secured to member 32 via fastening means 38 and the paper sensing apparatus 8 as will be described in more detail hereinafter. The rear paper chute 32 is schematically represented as being secured to the printer main frame 40 via fastening means 42. The front paper chute 36 is schematically represented as being secured to printer main frame 40 via angle bracket 44 and fastening means 46 and 48. The front paper chute 36 includes a flange portion 50 which includes an aperture for receiving a pivot rod 52 therethrough (means for securing the pivot rod 52 to portion 50 while allowing rotation of the pivot rod not being shown). The front paper chute 36 further includes an upper flared portion 53 and an angled portion, or extension 55. Mounted to the rear end of front paper chute 36 is a flange, or projection member 56, which is adapted to receive and secure the other end of pivot rod 52 and also for mounting a switch means 58. Switch means 58, which may comprise a switch from the E61-50H series manufactured by Cherry Electrical Products, Waukegan, Illinois, or prfereably, a modified switch E61-96HE also available from Cherry Electrical Products, includes a lever arm 60 which is positioned in contact with the upper portion 62 (having end portion 61) of a pivotable sensing member 64. Although not shown in the figure, the output contacts 66 of switch means 58 are appropriately connected to give an indication to control circuitry associated with the printer (by providing a change in logic levels, for example) as to the position of lever arm 60, which in turn, indicates whether or not paper 10 is present between sensing member 64 and the adjacent portions of front paper chute 36, as will be set forth hereinafter, which will also provide, therefor, an indication whether the paper in storage member 16 has been depleted.

The pivotable sensing member 64 of paper sensing apparatus 8, the latter including the pivotable sensing member 64 switching means 58 and a cooperating portion of the inner wall of front paper chute 36, is arranged with respect to front paper chute 36 and flange portions 50 and 56 in a manner such that pivot rod 52 engages the end portions of the paper sensing member 64 to allow member 64 to pivot about pivot rod 52.

Figure 3:
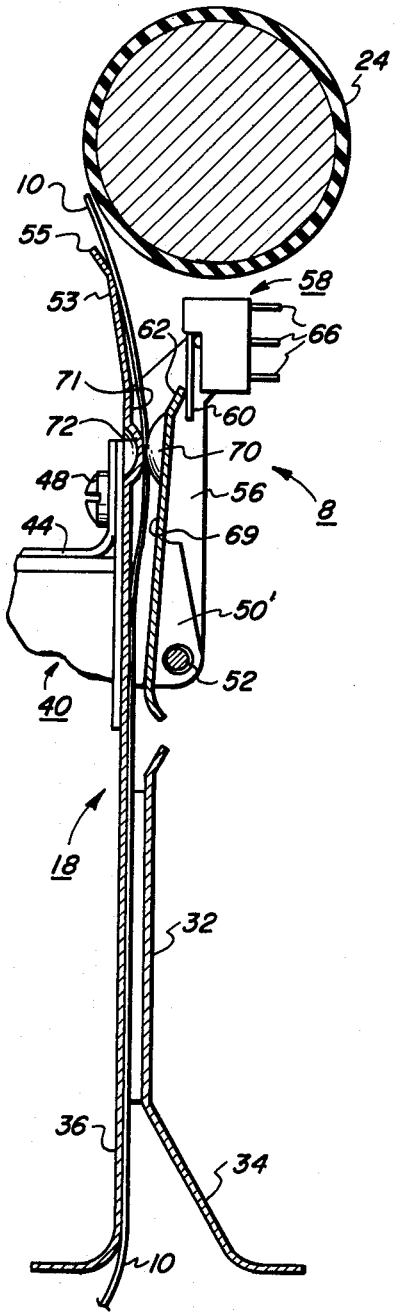
FIG. 3 is a partial sectional view of the apparatus of FIG. 1 with paper therein.
Figure 2:
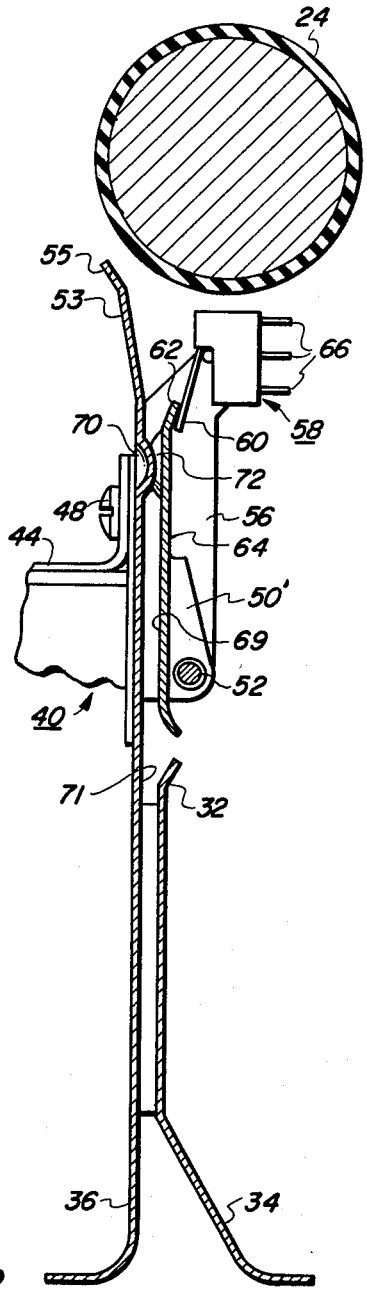
FIG. 2 is a partial sectional view of the apparatus of FIG. 1 with no paper therein.

It should be noted that in the sectional views of FIGS. 2 and 3 flared portion 50′ of sensing member 64 is rigidly secured to pivot rod 52 and when sensing member 64 is caused to be pivoted (rotated), both flared portion 50′ (and therefore sensing member 64) and pivot rod 52 are caused to be rotated.

Sensing member 64 includes on its inner surface, or wall, 69 a plurality of protrusions, or dimples 70, which extend in a row (in the plane of the figure) substantially coextensive with and along the length of the platen 24. Similarly, front paper chute 36 includes on its inner wall, or surface 71 a plurality of protrusions or dimples 72 which similarly extend in a row substantially coextensive with and along the length of the platen 24. The center of gravity of the sensing member 64 is preferably selected to be as close as practical to its pivot point (about pivot rod 52) to allow sensing member 64 to be slightly biased towards the inner wall 71 of front paper chute 36 (FIG. 2) when no paper is present in the paper chute assembly 9 (storage member 16 empty) or paper 10 has passed a predetermined position within the paper chute assembly 9. This latter condition occurs when the trailing edge of the paper in storage member 16 passes the horizontal row of protrusions on the inner walls of front paper chute 36 and sensing member 64. The bias is provided by the center of gravity of sensing member 64 and the return spring (not shown) for the lever 60 of switch means 58 (a counter balance or springs can be utilized in lieu of the lever return spring).

Figure 4:
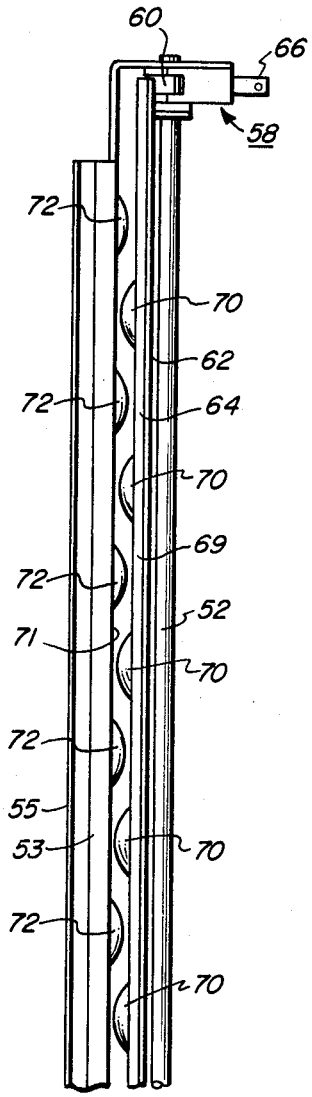
FIG. 4 is a front elevation view of the apparatus of FIG. 1 (with the platen removed) with no paper therein.

FIGS. 2 and 4 show a side sectional view (at approximately one-half the length of the paper chute assembly 9) and a front elevation view (with the platen 24 removed), respectively, with no paper being present in the paper chute assembly 9 (the storage member 16 therefore being depleted).

The sensing member 64 has a single horizontal row of dimple shaped protrusions 70 which extend towards the inner wall 71 of front paper chute 36. Similarly, front paper chute 36 has a single horizontal row of mating dimple-like protrusions 72 which extend towards the inner wall 69 of sensing member 64. The protrusions are positioned on the inner walls of the front paper chute 36 and the sensing member 64 in a manner whereby, in the no paper printer condition, the protrusions 72 fall between the protrusions 70 (in an interlocking type arrangement) on the inner wall 69 of sensing member 64 (although not shown in FIGS. 2 or 4, in the no paper condition the protrusions are preferably arranged to be biased into contact with inner wall opposite thereto). The protrusions each have a thickness associated therewith and preferably comprise a hollow dimple-like member. In a preferred arrangement, the protrusions on each wall are located approximately one inch from each other center-to-center and the center of a protrusion 70 on the inner wall 69 of sensing member 64 is located approximately ½ inch from the center of an adjacent protrusion on the inner wall 71 of front paper chute 36.

Figure 5:
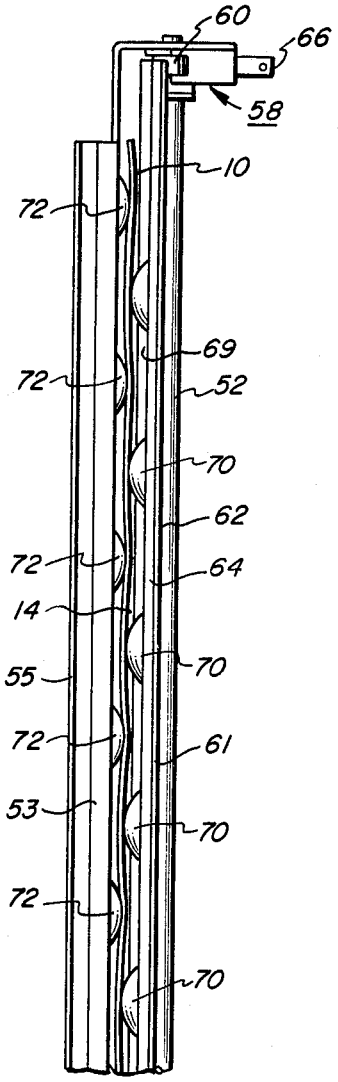
FIG. 5 is a front elevation view of the apparatus of FIG. 1 (with the platen removed) with paper therein.

The sensing member 64 is arranged to have 14 protrusions in the single horizontal row (only five being shown in FIGS. 4 and 5) whereas front paper chute 36 is arranged to have 15 protrusions in a corresponding single row (only five being shown in FIGS. 4 and 5).

The protrusions, rear paper chute 32, front paper chute 36 and sensing member 64, are preferably made of cold rolled steel, the protrusions being spherical in shape. In a preferred embodiment the protrusions 70 extend approximately 0.1 inches from inner wall 69 and have a spherical radius of 0.28 inch whereas protrusions 72 extend approximately 0.08 inches from inner wall 71 and also have a spherical radius of 0.28 inches.

FIG. 2 further illustrates the row alignment of the protrusions on sensing member 64 and front paper chute 36, protrusions 72 being positioned ahead of the adjacent protrusion 70 in the illustrated view. The angled position of lever arm 60 as shown in the figure causes switch means 58 to provide an indication to the printer control circuitry (not shown) that the printing paper 10 has been depleted from the paper storage member 16, the spring for lever arm 60 also biasing sensing member 64 towards the opposing portion of the inner wall of front paper chute 36. Although the printer control circuit may perform various functions once the paper depletion condition is detected depending on the requirements of the end user of the printer system, the printer control circuitry is preferably arranged to shut down the printer and to provide an indication to the printer operator that more paper should be added.

FIGS. 3 and 5 show a side sectional view (at approximately one-half the length of the paper chute assembly 9) and a front elevation view (with the platen 24 removed), respectively, with paper 10 being guided through the paper chute assembly 9 and past sensing member 64. As can be seen, the slight bias of the sensing member 64 is overcome by the inherent characteristics of the paper being utilized. In particular, the weight of the paper 14 being driven between front paper chute 36 and sensing member 64 and the resistance of flexure set of paper 10 individually or both together are sufficient to overcome the slight bias of the sensing member 64 towards front paper chute 36, sensing member 64 being offset in distance from its bias position by an amount determined by the paper thickness. It can be seen, therefore, that sensing member 64 is self-adjusting and adjusts itself to accommodate the thickness of the paper utilized. The paper 10 is contacted by the alternate arrangement of protrusions 70 and 72 along the width of paper 10 moving through paper chute assembly 9.

As shown in FIG. 3, lever arm 60 of switch means 58 in this situation (paper within paper chute assembly 9 and passing sensing member 64 as shown) is moved to a substantially vertical position by the top portion 62 of sensing member 64 as the sensing member is caused to be pivoted around pivot rod 52 by the passage of paper 10 between protrusions 70 and 72. It should be noted that the actual position of lever arm 60 is determined by the amount that sensing member 64 is caused to pivot which is dependent upon the thickness of paper 10. In any event, sensing member 64 is self-adjusting in the sense that paper of various thicknesses will cause sensing member 64 to pivot and interact with lever arm 60 of switch means 58 without any adjustment being required. The position of lever arm 60 attained due to the pivotable movement of sensing member 64 causes switch means 58 to provide an indication to the printer control circuitry that paper is still available for printing.

Although the alternate positions of the protrusions 70 and 72 may cause paper 10 to be slightly rippled as it is guided through front paper chute 36 and past sensing member 64, flared portion 53 of front paper chute 36 while guiding the paper 10 towards platen 24, also acts to substantially eliminate any ripples which may exist if the paper 10 exited directly to the platen 24 from the horizontal row of protrusions.

The sensing member 64, and in particular, the horizontal row of protrusions 70 associated therewith and the portion of the front paper chute 36 operatively associated with sensing member 64 (i.e. the portion of inner wall 71 having the mating protrusions 72 formed thereon) provide many advantages over the prior art paper out sensors due to the interlocking arrangement of protrusions 70 and 72 along the substantial length of the platen 24. In particular, there is no need to readjust for different widths of the paper 10 being run since the sensing member 64 extends over substantially the entire length of the printer platen 24 (as does front paper chute) and will sense paper anywhere along the length thereof. Further, there is no need to adjust for the thickness of the paper being utilized since the bias of the sensing member 64 towards front paper chute 26 is selected such that any thickness paper will cause lever arm 60 to change its position from a position corresponding to no paper to one where paper is present such that an appropriate indication thereof will be provided to printer control circuitry i.e. the sensing member 64 is self-adjusting.

Additionally, the protrusions 70 and 72 effectively amplify the pivotable motion of the sensing member 64 so that switch means 58 (via lever arm 60) can detect the presence of paper having the thicknesses which normally would be difficult to detect if the inner walls of sensing member 64 and front paper chute 36 were flat.

The relatively smooth, spherical protrusions 70 and 72 allow sidewise or lateral motion of the paper 10 as it is unfolded and brought up through the paper chute apparatus 9 if, for example, storage member 16 is initially misaligned with the opening in member 22, without the paper 10 being caught by edges or other surfaces as may occur in prior art sensing devices. The sensing member 64 also acts as a paper drag which, in the situation wherein folded, continuous form paper 10 is utilized for printing causes the paper and the folds 12 therein to conform closely to the surface of platen 24 which allows printing to be accurately accomplished on the fold 12 and minimizes the loss of information which otherwise may occur.

While the invention has been described with reference to its preferred embodiments it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. Apparatus for sensing whether record material is being supplied to the platen of a printer, said apparatus comprising:

a fixed guide member including a first inner wall having a first set of rounded protrusions thereon extending in a row substantially coextensive with and along the length of said platen;

a movable guide member mounted adjacent said fixed guide member for movement toward and away from said fixed guide member, said movable guide member being normally biased into a predetermined position relative to said fixed guide member when no record material is being supplied between said guide members to said platen, and being movable away from said predetermined position when record material is being so supplied, said movable guide member including a second inner wall facing said first inner wall, said second inner wall having a second set of rounded protrusions thereon extending in a row substantially coextensive with and along the length of said platen, said first and second sets of rounded protrusions being mutually offset from one another such that the protrusions of the two sets will intermesh with each other in the absence of paper; and sensing means mounted to said fixed guide member and responsive to the position of said movable guide member relative to said fixed guide member for providing an indication as to whether or not said movable guide member is at said predetermined position.

2. The apparatus of claim 1, wherein said sensing means comprises a movable lever in contact with said movable guide member, and a switch connected to and responsive to the position of said lever, said switch generating a signal when said lever is at a position corresponding to said movable guide member being at said predetermined position.

3. The apparatus of claim 1, wherein said sensing means comprises a lever in contact with said movable guide member, and a switch connected to and responsive to the position of said lever, said switch generating a signal when said lever is at a position corresponding to said movable member not being at said predetermined position.

* * * * *